United States Patent [19]

Tolley et al.

[11] 4,197,276

[45] Apr. 8, 1980

[54] RECOVERY OF TITANIUM METAL VALUES

[75] Inventors: William K. Tolley, Arlington Heights; John C. Stauter, Streamwood, both of Ill.

[73] Assignee: UOP Inc., Des Plaines, Ill.

[21] Appl. No.: 929,606

[22] Filed: Jul. 31, 1978

[51] Int. Cl.[2] ..... C01G 23/02; C01G 23/00

[52] U.S. Cl. ..... 423/82; 75/1 T; 75/101 R; 75/114; 423/85; 423/86

[58] Field of Search ..... 423/82, 83, 85, 86; 75/101 R, 114, 1 T

[56] References Cited

U.S. PATENT DOCUMENTS

| | | | |
|---|---|---|---|
| 2,088,913 | 8/1937 | Llewellyn | 423/86 |
| 3,236,596 | 2/1966 | Ziriglel et al. | 423/83 |
| 3,529,931 | 9/1970 | Moklebust | 423/86 |
| 3,787,139 | 1/1974 | Uster | 423/82 |
| 3,929,962 | 12/1975 | Shiah | 423/83 |
| 3,977,862 | 8/1976 | Glaeser | 423/83 |
| 4,019,898 | 4/1977 | Chen et al. | 423/82 |

*Primary Examiner*—Herbert T. Carter

*Attorney, Agent, or Firm*—James R. Hoatson, Jr.; Raymond H. Nelson; William H. Page, II

[57] ABSTRACT

Titanium metal values may be recovered from iron and titanium bearing sources such as an ilmenite ore by subjecting the source to a reductive roast after having crushed the source to a desired particle size. The reduced source is then leached by treatment with a halogen-containing compound to form soluble titanium halides and iron halides. Thereafter, the soluble titanium halide is precipitated as titanium dioxide by treatment with an iron oxide such as ferric oxide. The desired titanium dioxide or rutile may be recovered without an appreciable loss by effecting the leach step of the process in such a manner so that the solution potential is not greater than about +150 millivolts.

4 Claims, No Drawings

RECOVERY OF TITANIUM METAL VALUES

BACKGROUND OF THE INVENTION

Titanium in metallic form or as a compound is an important element in the chemical series. For example, titanium dioxide is utilized in paint pigments, in white rubbers and plastics, floor coverings, glassware and ceramics, painting inks, as an opacifying agent in papers, etc. The other titanium compounds are used in electronics, as fire retardants, waterproofing agents, etc. The metal may be used as such or in alloy form as structural material in aircraft, in jet engines, marine equipment, textile machinery, surgical instruments, orthopedic appliances, sporting equipment, food handling equipment, etc. Heretofore in recovering the titanium from titanium bearing sources such as ilmenite, rutile, etc., the titanium has been subjected to separation steps which involve the formation of titanium as a compound in a valence state of +4, such compounds usually involving titanium oxide. However, when attempting to separate titanium dioxide from impurities which are also contained in the ore such as iron, the hydrolysis of the titanium dioxide at elevated temperatures usually results in also obtaining relatively large amounts of iron along with the titanium.

Heretofore in the prior art various methods have been utilized to recover titanium values from titanium bearing sources. For example, in U.S. Pat. No. 3,236,596 an unroasted ilmenite ore is leached with hydrogen chloride at an elevated temperature. Following this, dissolved iron is reduced with iron or other reductants to precipitate ferrous chloride by saturating the liquor with hydrogen chloride gas. The hydrogen chloride is then extracted from the liquor by a vacuum distillation and the titanium is recovered by conventional means. Likewise, U.S. Pat. No. 3,825,419 reduces an ilmenite ore to produce ferrous oxides. The reduced ore is then leached for about 4 hours under a moderate pressure thereby dissolving the iron in the acid along with about 15% of the titanium. The iron is recovered as impure ferric oxide by spray roasting the solution while the insoluble leach product which is primarily titanium dioxide but which contains all of the silica present in the original ore is recovered. U.S. Pat. No. 3,859,077 also discloses a process for recovering titanium in which a titanium tetrahalide is mixed with iron oxide in slag or a titaniferous ore at an extremely high temperature of about 1000° C. to produce volatile impurity chlorides and titanium dioxide. A similar patent, U.S. Pat. No. 3,929,962, also reduces a titanium bearing ore at a high temperature to produce titanium sesquioxide which is in a form whereby it is easier to treat for a titanium-iron separation. Another prior art reference, U.S. Pat. No. 3,903,239 teaches a method for recovering titanium in which unroasted ilmenite is leached over a period of days at room temperature to recover about 80% of the titanium. Sulfur dioxide is added during the leach process to cause a precipitation of the ferrous chloride after which titanium dioxide is recovered by diluting and heating the solution. U.S. Pat. No. 3,076,692 also discusses the problem of minimizing the loss of titanium when leaching to produce titanium in a +4 valence state. The process described in this reference attempts to overcome the loss problem by utilizing a relatively short leach time, i.e., 10–20 minutes, or by adding phosphorous compounds.

In constradistinction to the prior art methods hereinbefore set forth for recovering titanium metal values from a titanium bearing source, it has now been found possible to effect a titanium value recovery from a source such as ilmenite in such a manner so that the loss of titanium is minimal in nature.

SPECIFICATION

This invention relates to a process for obtaining titanium values from a source which contains iron and titanium. More specifically, the invention is concerned with a process whereby the loss of titanium during the various steps of the process is minimized, thereby assuring a more complete recovery of the desired product. By utilizing the process of the present invention, it is possible to allow virtually complete dissolution of ilmenite ores in hydrochloric acid, the dissolved metal halides being stable at relatively high temperatures for a longer period of time than was heretofore possible. For example, by utilizing the operating parameters of the leach solution it is possible, if so desired, to effect the leach at a relatively high temperature, that is, about 100° C. for a period of time which may range up to about 2 hours in duration without the attendant loss of titanium.

However, by utilizing operating parameters of the type hereinafter set forth in greater detail, it is possible to effect the leach of the treated ore in a relatively short period of time, that is, about 0.25 hours to about 0.5 hours in duration. In addition, excessively high roasting temperatures as well as relatively long periods of roast are avoided along with the attendant use of normal roasting equipment. Another advantage which may be found by utilizing the process of the present invention is that it is not necessary to submit the ore to a grinding operation whereby the particle size of the ground ore is excessively small in order to obtain a high recovery of titanium.

It is therefore an object of this invention to provide an improved process for the obtention of desired titanium metal values.

A further object of this invention is to provide a hydrometallurgical process for obtaining high yields of titanium metal values in an economical manner.

In one aspect an embodiment of this invention resides in a process for the recovery of titanium metal values from a titanium bearing source which comprises the steps of grinding said titanium bearing source, subjecting the ground titanium bearing source to a reductive roast in the presence of a reducing agent at an elevated temperature, leaching the reduced source with a leach solution comprising a halogen-containing compound, separating the insoluble gangue from the soluble metal halides, precipitating titanium dioxide from the soluble metal halides by treating with iron oxides, separating said titanium dioxide from soluble iron halide, and recovering the desired titanium dioxide, the improvement in said process which comprises effecting the leach of the reduced titanium bearing source at a solution potential of less than about +150 millivolts as measured against a saturated calomel electrode.

A specific embodiment of this invention is found in a process for the recovery of titanium metal values from a titanium bearing source which comprises grinding said titanium bearing source, subjecting the ground source to a reductive roast in the presence of a reducing agent such as hydrogen at a temperature in the range of from about 600° to about 900° C., leaching the reduced source with a leach solution comprising hydrogen chloride, the solution potential of said leach solution being maintained in a range of from about −50 to about +150 millivolts based on a standard calomel reference electrode, separating the insoluble gangue from soluble metal halides, precipitating titanium dioxide by treatment with ferric oxide and recovering the desired titanium dioxide.

Other objects and embodiments with be found in the following further detailed description of the present invention.

As hereinbefore set forth, the present invention is concerned with an improvement in a process for the recovery of titanium metal values from a titanium bearing source. The overall process for the recovery of titanium metal values from such a source involves crushing an ore source such as ilmenite or other sources such as set forth which contains the desired metals, chiefly titanium as well as iron and minor amounts of vanadium, chromium, manganese, etc., to a particle size of less than about 35 mesh to 100 mesh (Tyler). Thereafter, the crushed metal bearing source is subjected to a reductive roast at an elevated temperature which may range from about 600° up to about 900° C. or more in the presence of a reducing gas such as hydrogen, carbon monoxide, combinations of carbon monoxide and hydrogen, etc., or any other suitable reductant for a period of time which may range from about 0.25 up to about 2 hours or more. In the preferred embodiment of the invention, the reducing atmosphere which is used to accomplish the purpose of the roast usually comprises a mixture of about 50% carbon monoxide and 50% hydrogen, the amount of reductant used being that which is necessary to completely reduce the iron which is present in the system to the zero valence state or elemental metal. In addition, if so desired, the crushed ore may be subjected to an oxidation roast prior to the reductive roast, said oxidative roast being accomplished at a temperature in the range of from about 600° to about 900° C. in the presence of an oxidizing atmosphere which is provided for by the presence of air or oxygen.

Following the reductive roast of the metal bearing source, the reduced source is then subjected to an aqueous leach which, in the preferred embodiment of the invention, comprises an aqueous hydrogen halide solution. The preferred hydrogen halide is hydrogen chloride, although other hydrogen halides such as hydrogen bromide and hydrogen iodide may also be utilized, although not necessarily with equivalent results. The aforesaid leach of the metal bearing source is usually effected at a temperature which may range from about ambient up to about 110° C., the preferred rang being from about 80° to about 100° C., for a period of time ranging from about 0.25 hours up to about 1 hour or more in duration.

Following the leach of the metal bearing source which will form soluble iron halides and titanium halides such as ferrous chloride, titanium trichloride, etc., the mixture is subjected to a separation step in which the solid gangue is separated from the soluble metal chlorides and discarded. The separation of the solid gangue from the soluble metal chlorides may be effected in any suitable manner by means well known in the art, said means including decantation, filtration, etc. The soluble metal halides are then subjected to a precipitation step in a precipitation zone whereby the aqueous metal halides such as titanium trichloride and ferrous chloride are subjected to reaction with an iron oxide, preferably one in which the iron is present in its highest valence state such as ferric oxide. In this precipitation zone where the treatment is effected at temperatures ranging from about 80° to 110° C., the iron oxide such as ferric oxide will react with titanium trichloride to form solid titanium dioxide. This compound, after separation from the soluble iron halides in a solid/liquid separation zone, will be recovered as such and may thereafter be treated to recovery as titanium metal, if so desired. Following separation of the solid titanium dioxide from the soluble ferrous chloride, the latter is passed to a crystallization zone wherein the temperature is reduced to afford crystallization of the ferrous chloride. For example, the temperature at which the crystallization or precipitation of the ferrous chloride is effected may range from about 0° to slightly in excess of ambient or, in extreme cases, up to about 90° C. When utilizing subambient temperatures the cooled solution is maintained in the desired subambient range by external means such as an ice bath, cooling coils, etc. After crystallization of the ferrous chloride is completed, the solids are separated from the leach liquor which may be recycled back to the leach zone. The solid ferrous chloride is recovered and a major portion of the product is subjected to a direct reduction step which is effected at an elevated temperature in the range of from about 600° to about 900° C. in contact with an excess of hydrogen. In this direct reduction step, the metallic iron which is produced will be in the form of powder or crystals and may be recovered as such. In addition, the hydrogen chloride which is formed during the direct reduction of the ferric chloride to metallic iron is withdrawn and recycled to the leach step of the process to make up a portion of the leach solution. While a major portion of the ferrous chloride in an amount ranging from 50% to 90% is subjected to this direct reduction, the remaining portion in an amount ranging from about 10% to about 50% is subjected to an oxidation step. In the oxidation step the ferrous chloride is treated at an elevated temperature ranging from about 300° to about 800° C. by contact with an oxygen-containing gas such as air or oxygen, the preferred oxidizing agent comprising air due to its greater availability and negligible cost. As in the case of the direct reduction, any hydrogen chloride which may be formed during the oxidation step is recycled to the ferrous chloride crystallization zone to saturate said zone in order to insure a complete precipitation of the ferrous chloride by reducing the solubility of said compound. In the oxidation zone the reaction of the ferrous chloride with an oxidizing agent results in the formation of iron oxides such as ferrous oxide, ferric oxide, these compounds being charged to the zone containing the titanium trichloride wherein said titanium trichloride is contacted with the iron oxides to form titanium dioxide.

It has now been discovered that when the leach of the reduced titanium mineral source is effected under a controlled solution potential, it is possible to recover a greater amount of titanium in the subsequent steps of precipitation and recovery. The solution potential (Eh) of the slurry at the end of the leach period, as measured with a platinum electrode, should be maintained within the range of from about −50 to about +150 millivolts based on a standard calomel reference electrode. The solution potential of the leach solution is the measurement of the electrode potential (electrochemical drive) of the ions and measures the activity of one species of ion to another. By maintaining the solution potential within the aforesaid range, it is possible to prevent the formation of titanium dioxide during the leach. The curtailment of the formation of titanium dioxide, which would be in solid form, will prevent the loss of titanium from the leach solution inasmuch as upon completion of the leach operation the solids such as gangue or other insoluble metal compounds are removed from the solution by filtration, thickening, or any other means known in the art, following which the solids are either discarded or subjected to further treatment to recover other valuable metals or metal compounds. Prior to initiating the leach process, the initial solution potential is adjusted by the addition of various compounds in order to insure the fact that the final solution potential will be within the desired range. In the present case, the solution potential will be the measure of the concentration of the various ions in the leach solution and therefore the adjustment of the solution potential to insure being within the desired range is accomplished by the addition of either iron as a metal or a reduced ilmenite compound whereby the solution potential may be reduced if it is in excess of +150. Conversely, in the event that the initial solution potential is less than −50 millivolts, the addition of an oxidized solution such as iron in a +3 valence state in a stront acid solution such as hydrochloric acid whereby the iron is present as a chlorocomplex will increase the solution potential to within the desired range. By effecting the leach of the reduced source within the range hereinbefore set forth, it is possible to retain over about 99% of the solubilized titanium in solution over a long period of time.

The process of the present invention may be effected in any suitable manner and may comprise either a batch or continuous type operation. For example, when a batch type operation is used a titanium bearing source such as ilmenite ore which has been crushed to the desired particle size is subjected to a reductive roast. In the reductive roast the crushed ore is contacted with a reductant such as a mixture of carbon monoxide and hydrogen at a temperature within the range hereinbefore set forth and for a predetermined period of time. Following the reductive roast step the ore is then placed in an appropriate apparatus where it is contacted with a leach solution. In the preferred embodiment of the invention the leach solution comprises an aqueous hydrogen chloride solution. In the leaching zone the solution potential at which the ore undergoes leach is controlled within the range hereinbefore set forth, that is, from about −50 to about +150 millivolts based on a standard calomel reference electrode. In order to maintain the solution potential within this range control reagents such as metallic iron or a reduced ilmenite source is added to lower the solution potential in the event that it is above the desired range, or by the addition of an oxidized solution containing iron in a +3 valence state if the solution potential is below the desired range. After completing the leach which may be effected at temperatures ranging from ambient to about 110° C., the solid material comprising gangue or other insoluble metal componds is separated from the leach liquor, the latter than being placed in an apparatus whereby it is contacted with iron oxides and preferably ferric oxide at an elevated temperature ranging from about 80° to 110° C. Afterformation and precipitation of titanium dioxide by treatment with the ferric oxide, the solid titanium dioxide is separated from the leach liquor and recovered. The leach liquor is then treated to precipitate ferrous chloride which may then be treated by a direct reductive step to recover metallic iron and hydrogen chloride or, in the alternative, it may be subjected to an oxidation step to produce ferric oxide which can be reused in the treatment of the soluble titanium chloride to form the desired titanium dioxide.

As an alternative method of recovering the desired product the leach liquor which contains the soluble ferrous chloride and titanium chloride after separation from the solid gangue material may be placed in an apparatus which is maintained at a temperature lower than that at which the leach is effected. The result of this lowering of the temperature will be the formation of crystalline ferrous chloride. After crystallization of the ferrous chloride is complete, the soluble titanium chloride may be separated from the crystals by conventional means such as filtration, decantation, etc., and the solution then treated with ferric oxide in a manner similar to that hereinbefore set forth to form titanium dioxide which is then separated and recovered. The solid ferrous chloride obtained in the previous precipitation step may then be subjected to a direct reduction by treatment with hydrogen at an elevated temperature to again form metallic iron and hydrogen chloride or to an oxidation process by treatment with an oxygen-containing gas at an elevated temperature to form ferric oxide.

It is also contemplated within the scope of this invention that the process may be effected utilizing a continuous method of operation. When utilizing the continuous method operation, the ore, which has been crushed in a crushing zone to the desired particle size, is continuously fed to a reducing roast zone wherein the ore is subjected to a reductive roast utilizing a reductant comprising either hydrogen, carbon monoxide or a combination thereof which is also continuously charged through this zone. After passage through the zone for a predetermined period of time, the reduced charge is continuously withdrawn and passed to a leaching zone wherein it is subjected to leach treatment with a hydrogen halide such as an aqueous hydrogen chloride solution. The solution potential of this leach is monitored while the ore is passing through the zone and is maintained within the hereinbefore set forth range by charging metallic iron or reduced ilmenite or iron in a +3 valence state to the leach zone as called for. After passage through the leaching zone the pregnant leach liquor containing dissolved metal chlorides along with undissolved solids such as gangue or insoluble metal compounds is continuously withdrawn and passed to a filtration zone or separation zone wherein the soluble metal halides are separated from the solids. After passage through the filtration zone the pregnant leach liquor is continuously passed to a precipitation zone wherein the leach liquor is contacted with ferric oxide to effect a precipitation of titanium dioxide. The mixture of solid titanium dioxide and leach liquor containing soluble ferrous chloride is continuously withdrawn after passage through the zone to a solid/liquid separation zone wherein the solid titanium dioxide is separated and continuously withdrawn from the leach liquor and passed to storage.

The leach liquor is also continuously withdrawn from the separation zone and passed to a crystallization zone which is maintained at a lower temperature than that of the previous zones. In the crystallization zone the ferrous chloride crystallizes out of the leach liquor which is continuously withdrawn and recycled to the leach zone. The solid ferrous chloride in crystalline form is continuously withdrawn from this zone and may, if so desired, be passed to a reduction zone wherein it undergoes the direct reduction in the presence of hydrogen to form metallic iron. Metallic iron which is formed in the reduction zone is continuously withdrawn and passed to storage while the hydrogen chloride which is formed during the reduction is also continuously withdrawn and recycled to the leaching zone to form a portion of the leach solution. In the alternative, if so desired, the ferrous chloride which has been withdrawn from the crystallization zone may be passed to an oxidation zone wherein it is contacted with an oxygen-containing gas at an elevated temperature to form a mixture of iron oxides, namely, ferric oxide. These compounds are continuously withdrawn from the oxidation zone and passed to the precipitation zone hereinbefore set forth for contact with the pregnant leach liquor to effect the formation of solid titanium dioxide. Any hydrogen chloride which is formed during the reaction in the oxidation zone is also continuously withdrawn and passed to the crystallization zone wherein it is used to saturage the zone to reduce the solubility of the ferrous chloride contained therein.

In the event that an alternative method of effecting the entire process of this invention is desired, the leach liquor which contains dissolved metal chlorides, after separation from undissolved solids such as gangue, etc., is continuously withdrawn from the separation zone and passed to a crystallization zone which is maintained at a temperature lower than that of the leach zone. In the crystallization zone the ferrous chloride crystallizes out of the leach liquor, the latter then being continuously withdrawn while the solid ferrous chloride is treated in a manner similar to that hereinbefore set forth, that is, either by direct reduction to metallic iron or an oxidation to ferric oxide. The leach liquor which is continuouslu withdrawn from the crystallization zone is then passed to a precipitation zone wherein it is contacted with ferric oxide which is also continuously charged to the precipitation zone. After formation of solid titanium dioxide in this precipitation zone, the desired product is separated from the liquor and passed to storage.

The following examples are given for purposes of illustrating the process of this invention. However, it is to be understood that the examples are given merely for purposes of illustration and that the present process is not necessarily limited thereto.

EXAMPLE I

A Canadian ilmenite ore which was analyzed and found to contain 28% titanium, 30% iron, and 0.066% vanadium was ground to a particle size in hich the bulk of the particles were −100 mesh. Thereafter the material was placed in a quartz furnace tube and roasted at a temperature of 775° C. for a period of 75 minutes using a mixture of hydrogen and carbon monoxide as the reductant.

Following the reduction, 50 grams of the ore was placed in a 500 ml spherical reaction flask fitted with a reflux condenser. The leach solution comprising 300 ml of concentrated hydrochloric acid was added to the flask and the slurry was agitated by a magnetic stirring bar. The leach was effected at a temperature of 100° C. for a period of 2 hours, the temperature being provided for by a heating mantel powered through a constant temperature control. At the end of the leach period the solution was filtered to remove insoluble gangue and cooled. During the leach period the solution potential ranged from −80 millivolts to −110 millivolts. The percentage of titanium extraction at the end of 15 minutes and at the end of 2 hours was measured. It was found that 26% of the titanium was extracted after 15 minutes but only 10% of the titanium was extracted after 2 hours, the remainder of the titanium being converted to titanium dioxide which was insoluble and which was removed along with the gangue. In addition the extraction of iron was also analyzed and found to comprise 57% at the end of 15 minutes.

EXAMPLE II

Canadian ilmenite ore was treated in a manner similar to that set forth in Example I above, that is, it was ground to −100 mesh and reduced at a temperature of 775° C. for a period of 75 minutes under a stream of carbon monoxide and hydrogen reductants. The thus reduced ore was then leached in a reaction flask at a temperature of 100° C. for a period of time ranging from 15 minutes to 2 hours with agitation. At the end of the 2 hour period the leach solution was filtered and the solution was analyzed to determine titanium and iron recovery. In contrast to the solution potential as expressed in Example I, the solution potential in this example ranged from 10 millivolts at 15 minutes to 25 millivolts at the end of 2 hours. At the end of 15 minutes thjere had been a 91% extraction of titanium as titanium chloride which dropped to 51% titanium extraction at the end of 2 hours. Iron recovery was improved in that there was a 92% extraction of iron at the end of 15 minutes and a 99% extraction of iron at the end of 2 hours.

A repeat of the above experiment in which the solution potential of the leach solution was 10 millivolts at the end of 15 minutes and 20 millivolts at the end of 2 hours resulted in a 99% extraction of the titanium at the end of 15 minutes and a 98% extraction of titanium at the end of 2 hours. Iron extraction also was maintained at a high level, there being extracted 99% of the iron after both 15 minutes and 2 hours.

We claim as our invention:

1. In a process for the recovery of titanium metal values from a titanium bearing source which comprises the steps of:

(a) grinding said titanium bearing source;
(b) subjecting the ground titanium bearing source to a reductive roast in the presence of a reducing agent at an elevated temperature;
(c) leaching the reduced source with a leach solution comprising a halogen containing compound;
(d) separating the insoluble gangue from the soluble metal halides;
(e) precipitating titanium dioxide from the soluble metal halides by treating with iron oxides;
(f) separating said titanium dioxide from soluble iron halide; and
(g) recovering the desired titanium dioxide, the improvement which comprises prior to effecting the leach of the reduced titanium bearing source adjusting the solution potential in the range of from about +150 millivolts to about −50 millivolts measured against a saturated calomel electrode by adding metallic iron or a reduced iron compound when the solution potential is in excess of +150 millivolts or an oxidized solution containing iron in the +3 valence state as a chlorocomplex when the solution potential is less than −50 millivolts, monitoring and maintaining the solution potential within said range during the leach to prevent formation of titanium dioxide.

2. The process as set forth in claim 1 furthe characterized in that said reductive roast is effected at a temperature in the range of from about 600° to about 900° C.

3. The process as set forth in claim 1 further characterized in that said halogen containing compound is hydrogen chloride.

4. The process as set forth in claim 1 further characterized in that the precipitation of said titanium dioxide is effected at a temperature in the range of from about 80° to about 110° C.

* * * * *